US009812061B2

(12) United States Patent
Liu et al.

(10) Patent No.: US 9,812,061 B2
(45) Date of Patent: Nov. 7, 2017

(54) DISPLAY APPARATUS AND OPERATION METHOD THEREOF

(71) Applicant: AU OPTRONICS CORP., Hsin-Chu (TW)

(72) Inventors: Li-Wei Liu, Hsin-Chu (TW); Yi-Cheng Lin, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 105 days.

(21) Appl. No.: 14/691,665

(22) Filed: Apr. 21, 2015

(65) Prior Publication Data

US 2016/0247450 A1 Aug. 25, 2016

(30) Foreign Application Priority Data

Feb. 24, 2015 (TW) ..... 104105852 A

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0842* (2013.01);
(Continued)

(58) Field of Classification Search
CPC ..... G09G 3/3258; G09G 2330/028; G09G 2330/10; G09G 2310/0262;
(Continued)

(56) References Cited

U.S. PATENT DOCUMENTS 7,355,574 B1 4/2008 Leon et al.
7,907,105 B2 3/2011 Shirasaki et al.
(Continued)

FOREIGN PATENT DOCUMENTS

CN 101976679 2/2011
CN 103268756 8/2013
(Continued)

OTHER PUBLICATIONS

Taiwan Intellectual Property Office, Office Action dated Aug. 22, 2016.

*Primary Examiner* — Ibrahim Khan
(74) *Attorney, Agent, or Firm* — WPAT, PC

(57) ABSTRACT

A display apparatus includes a display unit, a source driver, a gate driver and a compensation unit. The display unit includes at least a pixel unit. Each pixel unit includes a first transistor, a second transistor, a first capacitor, a second capacitor and an organic light emitting diode. When the pixel unit is operated in a display mode, the pixel unit outputs a sensing voltage including a first parameter having characteristics of the second transistor and a second parameter having characteristics of the organic light emitting diode. The source driver receives a compensation data and accordingly adjusts the next display data. The compensation unit is disposed between the second capacitor and the source driver and electrically coupled between the second end of the second capacitor and the source driver. The compensation unit receives the sensing voltage and outputs the compensation data according to the received sensing voltage.

10 Claims, 12 Drawing Sheets

(52) U.S. Cl.
CPC ..... *G09G 2300/0852* (2013.01); *G09G 2300/0866* (2013.01); *G09G 2310/0262* (2013.01); *G09G 2320/0204* (2013.01); *G09G 2320/0295* (2013.01); *G09G 2320/043* (2013.01); *G09G 2320/045* (2013.01); *G09G 2330/028* (2013.01); *G09G 2330/10* (2013.01)

(58) Field of Classification Search
CPC ..... G09G 2320/0204; G09G 2320/043; G09G 2300/0842
See application file for complete search history.

(56) References Cited

U.S. PATENT DOCUMENTS

| | | | | |
|---|---|---|---|---|
| 2008/0036703 | A1 | 2/2008 | Wang et al. | |
| 2011/0221720 | A1 | 9/2011 | Kuo et al. | |
| 2012/0293478 | A1* | 11/2012 | Chaji ..... | G09G 3/3258 345/212 |
| 2013/0127692 | A1* | 5/2013 | Yoon ..... | G09G 3/3258 345/80 |
| 2013/0257845 | A1* | 10/2013 | Chaji ..... | G09G 3/3291 345/212 |
| 2014/0125643 | A1 | 5/2014 | Kuo et al. | |
| 2014/0225883 | A1* | 8/2014 | Chaji ..... | G09G 3/3258 345/212 |

FOREIGN PATENT DOCUMENTS

| | | |
|---|---|---|
| CN | 203150074 | 8/2013 |
| EP | 2081176 | 7/2009 |
| TW | 201121354 | 6/2011 |
| TW | 201222511 | 6/2012 |
| TW | I400987 | 7/2013 |

* cited by examiner

DISPLAY APPARATUS AND OPERATION METHOD THEREOF

TECHNICAL FIELD

The present disclosure relates to a display apparatus, and more particularly to a display apparatus having a pixel unit compensation function.

BACKGROUND

Most of the current display apparatuses are implemented with liquid crystal displays (LCDs). Compared to the cathode ray tube (CRT) display, LCD has smaller size, high mobility, low power consumption, etc. However, in respond to the high demand of thin display apparatus and low power consumption, organic light emitting diode displays have been seen in market in recent years. The main difference between the organic light emitting diode displays and the conventional LCDs is that the organic light emitting diode displays have the self-luminance feature. Therefore, the organic light emitting diode displays have smaller size, lower manufacturing cost and less power consumption due to no backlight device is required. However, the pixel units in the organic light emitting diode display may have aging issue which is resulted by the repeating displaying operations, and consequentially the organic light emitting diode display may have incorrect display issues. Thus, it is quite important to develop a mechanism to effectively detect the aging of the pixel unit effectively and accurately compensate the aging in time.

SUMMARY

The present disclosure provides a display apparatus, which includes a display unit, a source driver, a gate driver and a compensation unit. The display unit includes at least a pixel unit. Each pixel unit includes a first transistor, a second transistor, a first capacitor, a second capacitor and an organic light emitting diode. The first transistor has a first end, a second end and a control end. The first transistor is configured to have its first end for receiving a display data and its control end for receiving a first control signal. The first transistor determines whether or not to output the display data to its second end according to the first control signal. The second transistor has a first end, a second end and a control end. The second transistor is configured to have its first end for receiving a power supply voltage and its control end electrically coupled to the second end of the first transistor. The first capacitor has a first end and a second end. The first capacitor is configured to have its first end electrically coupled to the second end of the first transistor and its second end electrically coupled to the first end of the second transistor. The second capacitor has a first end and a second end. The second capacitor is configured to have its first end electrically coupled to the second end of the second transistor and its second end for outputting a sensing voltage. The organic light emitting diode has a first end and a second end. The organic light emitting diode is configured to have its first end electrically coupled to the second end of the second transistor and its second end electrically coupled to a first low-level voltage. When the pixel unit is operated in a display mode, the organic light emitting diode is ON, and the sensing voltage includes a first parameter having characteristics of the second transistor and a second parameter having characteristics of the organic light emitting diode. The source driver is electrically coupled to the at least one pixel unit. The source driver is configured to receive a compensation data and accordingly adjust the next display data. The compensation unit is disposed between the second capacitor and the source driver and electrically coupled between the second end of the second capacitor and the source driver. The compensation unit is configured to receive the sensing voltage and output the compensation data according to the received sensing voltage.

The present disclosure further provides an operation method of a display apparatus. The display apparatus includes a display unit, a source driver and a compensation unit. The display unit includes at least a pixel unit. Each pixel unit includes a first transistor, a second transistor, a first capacitor, a second capacitor and an organic light emitting diode. The first transistor has a first end, a second end and a control end. The first transistor is configured to have its first end for receiving a display data, its control end for receiving a first control signal, and its second end for outputting the display data. The second transistor has a first end, a second end and a control end. The second transistor is configured to have its first end for receiving a power supply voltage and its control end electrically coupled to the second end of the first transistor. The first capacitor has a first end and a second end. The first capacitor is configured to have its first end electrically coupled to the second end of the first transistor and its second end electrically coupled to the first end of the second transistor. The second capacitor has a first end and a second end. The second capacitor is configured to have its first end electrically coupled to the second end of the second transistor and its second end for outputting a sensing voltage. The organic light emitting diode has a first end and a second end. The organic light emitting diode is configured to have its first end electrically coupled to the second end of the second transistor and its second end electrically coupled to a first low-level voltage. The source driver is electrically coupled to the at least one pixel unit. The compensation unit is disposed between the second capacitor and the source driver and electrically coupled between the second end of the second capacitor and the source driver. The operation method includes steps of: operating the pixel unit in a display mode and turning on the organic light emitting diode; configuring the compensation unit to receive the sensing voltage and output a compensation data; and configuring the source driver to receive the compensation data and adjust the next display data, wherein the sensing voltage comprises a first parameter having characteristics of the second transistor and a second parameter having characteristics of the organic light emitting diode.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
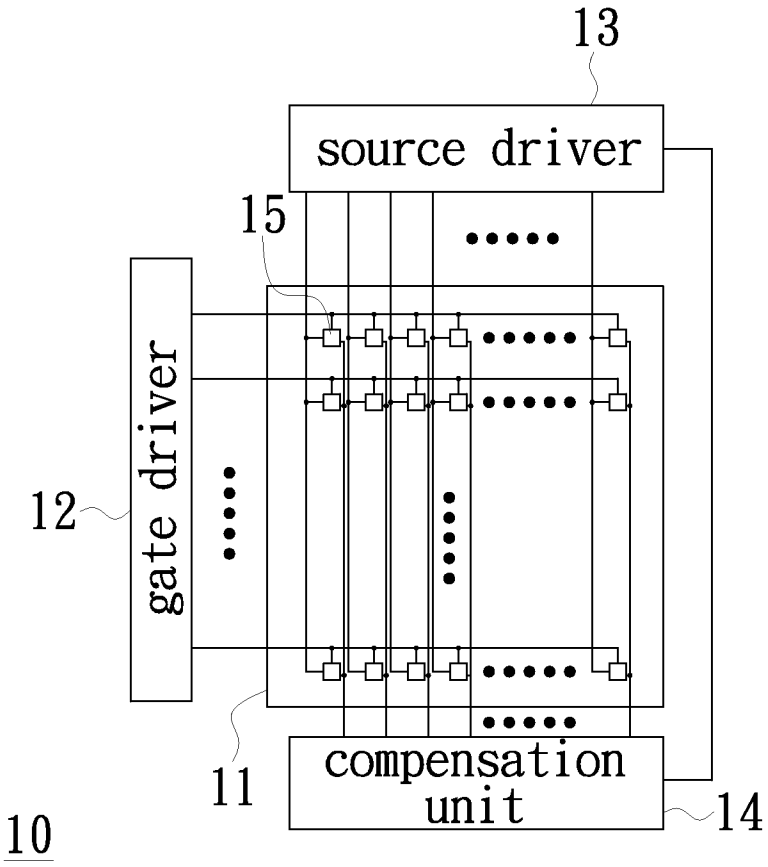
FIG. 1 is a schematic diagram of a display apparatus in accordance with the first embodiment of the present disclosure.

FIG. 1 is a schematic diagram of a display apparatus in accordance with the first embodiment of the present disclosure. As shown in FIG. 1, the display apparatus 10 in the present embodiment includes a display unit 11, a gate driver 12, a source driver 13 and a compensation unit 14. The display unit 11 includes at least one pixel unit 15, and each pixel unit 15 is electrically coupled to the gate driver 12, the source driver 13 and the compensation unit 14. The pixel unit 15 is configured to receive display data Data outputted from the source driver 13 and display the received display data Data according to a first control signal S1 outputted from the gate driver 12 to each pixel unit 15. Additionally, the pixel unit 15 is further configured to output a sensing voltage Sense to the compensation unit 14 while displaying the received display data Data. The compensation unit 14 is configured to output compensation data to the source driver 13 according to the received sensing voltage Sense. The source driver 13 is configured to adjust the next display data Data according to the current compensation data, so as to compensate the aging of the components in the pixel unit 15 according to the compensation data and prevent the pixel unit 15 from having the incorrect display issue.

Figure 2A:
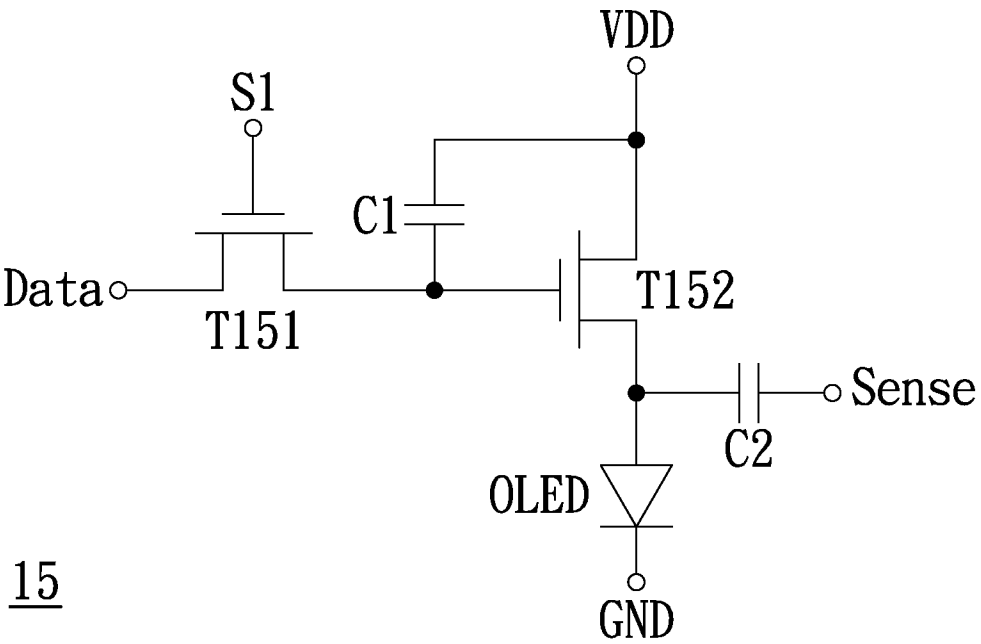
FIG. 2A is a schematic circuit diagram of a display unit in accordance with the first embodiment of the present disclosure.

FIG. 2A is a schematic circuit diagram of the display unit 15 in FIG. 1 in accordance with the first embodiment of the present disclosure. As shown in FIG. 2A, the pixel unit 15 in the present embodiment includes a transistor T151, a transistor T152, a capacitor C1, a capacitor C2 and an organic light emitting diode OLED. The transistor T151 has a first end, a second end and a control end. The transistor T151 is configured to have its first end electrically coupled to the source driver 13 and from which to receive the display data Data; and its control end electrically coupled to the gate driver 12 and from which to receive the first control signal S1. The transistor T152 has a first end, a second end and a control end. The transistor T152 is configured to have its first end for receiving a power supply voltage VDD; and its control end electrically coupled to the second end of the transistor T151. The capacitor C1 has a first end and a second end. The capacitor C1 is configured to have its first end electrically coupled to the second end of the transistor T151; and its second end electrically coupled to the first end of the transistor T152. The organic light emitting diode OLED has a first end and a second end. The organic light emitting diode OLED is configured to have its first end electrically coupled to the second end of the transistor T152; and its second end electrically coupled to a first low-level voltage GND. The capacitor C2 has a first end and a second end. The capacitor C2 is configured to have its first end electrically coupled to the second end of the transistor T152; and its second end for outputting the sensing voltage Sense to the compensation unit 14.

Figure 2B:
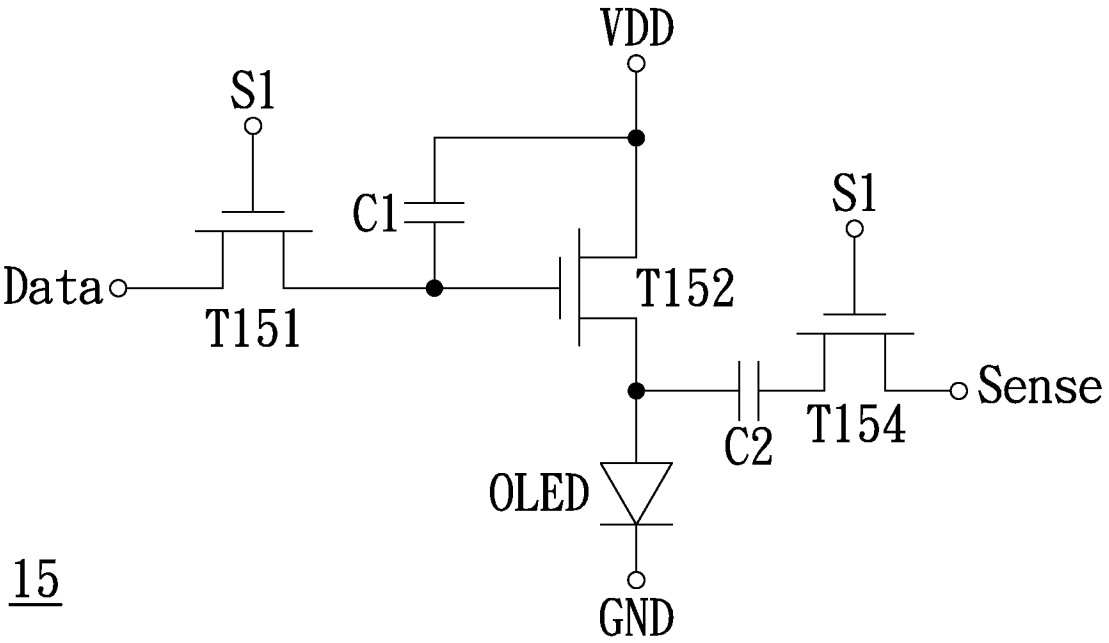
FIG. 2B is a schematic circuit diagram of a display unit in accordance with the second embodiment of the present disclosure.

FIG. 2B is a schematic circuit diagram of the display unit 15 in FIG. 1 in accordance with the second embodiment of the present disclosure. The display unit 15 of FIG. 2B in the present embodiment and the display unit 15 of FIG. 2A have similar technology features, no redundant detail is to be given herein. A difference lies in that the display unit 15 of FIG. 2B in the present embodiment further includes a transistor T154, besides the abovementioned transistor T151, transistor T152, capacitor C1, capacitor C2 and organic light emitting diode OLED. The transistor T154 has a first end, a second end and a control end. The transistor T154 is configured to have its first end electrically coupled to the second end of the capacitor C2; its control end for receiving the first control signal S1; and its second end for determining whether or not to output the sensing voltage Sense to the compensation unit 14 according to the received first control signal S1.

Figure 3:
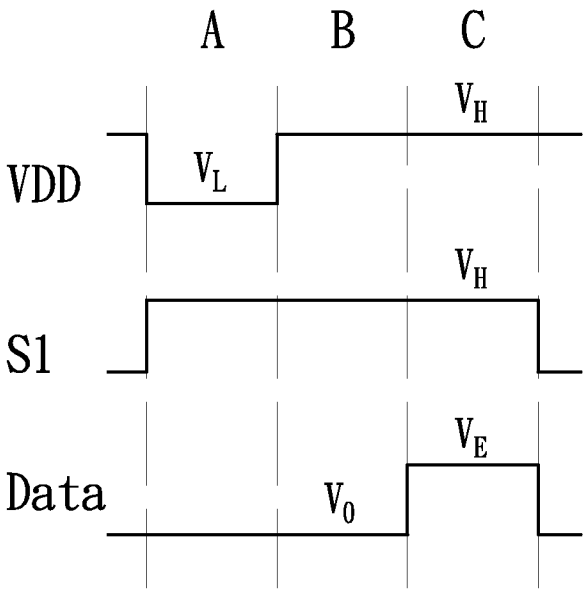
FIG. 3 is a timing chart of the related signals of the pixel units of FIGS. 2A and 2B in accordance with an embodiment of the present disclosure.

FIG. 3 is a timing chart of the related signals of the pixel units 15 of FIGS. 2A and 2B in accordance with an embodiment of the present disclosure. As shown in FIG. 3, the related signals include the power supply voltage VDD, the first control signal S1 and the display data Data. The following, in conjunction with FIGS. 2A and 3, describes an operation method of the pixel unit 15. First, the pixel unit 15 is operated in an initial mode (i.e. the period A in FIG. 3). The initial mode is for maintaining the first end of the organic light emitting diode OLED to have a low-level voltage. Specifically, in the initial mode, the display data Data has a second low-level voltage $V_0$; the power supply voltage VDD has a third low-level voltage $V_L$ which is lower than the second low-level voltage $V_0$; and the first control signal S1 has a high-level voltage $V_H$. According to the abovementioned signal configuration, the transistor T151 is ON by the first control signal S1; and the second low-level voltage $V_0$ is transmitted to the second end of the transistor T151 and the first end of the capacitor C1 has the second low-level voltage $V_0$. Additionally, because the effect of the power supply voltage VDD, the second end of the capacitor C1 has the third low-level voltage $V_L$; the transistor T152 is ON by the second low-level voltage $V_0$; and the second end of the transistor T152 is maintained to have the third low-level voltage $V_L$ due to the effect of the power supply voltage VDD. Moreover, because the difference between the first low-level voltage GND and the third low-level voltage $V_L$ is smaller than the driving voltage $V_{OLED}$ of the organic light emitting diode OLED, the organic light emitting diode OLED is OFF.

Next, the pixel unit 15 is operated in a compensation mode (i.e. the period B in FIG. 3). The compensation mode is for obtaining a first parameter (that is, the $V_{th}$ of the transistor T152). Specifically, in the compensation mode, the display data Data has the second low-level voltage $V_0$; the power supply voltage VDD has the high-level voltage $V_H$; and the first control signal S1 has the high-level voltage $V_H$. According to the abovementioned signal configuration, the transistor T151 is ON by the first control signal S1; and the second low-level voltage $V_0$ is transmitted to the second end of the transistor T151 and the first end of the capacitor C1 has the second low-level voltage $V_0$. Additionally, because the effect of the power supply voltage VDD, the second end of the capacitor C1 has the high-level voltage $V_H$; the transistor T152 is ON by the second low-level voltage $V_0$; the second end of the transistor T152 is converted from having the third low-level voltage $V_L$ to having the high-level voltage $V_H$ and has increasing voltage until the transistor T152 is OFF; and the second end of the transistor T152 is maintained to have a voltage $V_0-V_{th}$. Moreover, because the difference between the first low-level voltage GND and the voltage at the second end of the transistor T152 is smaller than the driving voltage $V_{OLED}$ of the organic light emitting diode OLED, the organic light emitting diode OLED is OFF.

Then, the pixel unit 15 is operated in a display mode (i.e. the period C in FIG. 3). Specifically, in the display mode, the display data Data has a display voltage $V_E$; the power supply voltage VDD has the high-level voltage $V_H$; and the first control signal S1 has the high-level voltage $V_H$. According to the abovementioned signal configuration, the transistor T151 is ON by the first control signal S1; the display voltage $V_E$ is transmitted to the second end of the transistor T151 and the first end of the capacitor C1 has the display voltage $V_E$. Additionally, because the effect of the power supply voltage VDD, the second end of the capacitor C1 has the high-level voltage $V_H$; and the transistor T152 is ON by the display voltage $V_E$. Moreover, because the second end of the transistor T152 is maintained to have the driving voltage $V_{OLED}$ due to that both of the power supply voltage VDD and the display voltage $V_E$ are higher than the driving voltage $V_{OLED}$ of the organic light emitting diode OLED, the organic light emitting diode OLED is ON. Because the voltage at the first end of the capacitor C2 increases from $V_0-V_{th}$ in the compensation mode to the driving voltage $V_{OLED}$, correspondingly the voltage at the second end of the capacitor C2 increases to $V_{OLED}-(V_0-V_{th})$ due to the capacitor coupling feature and consequentially the second end of the capacitor C2 can output the first parameter (the $V_{th}$ of the transistor T152) and the second parameter (that is, the driving voltage $V_{OLED}$ of the organic light emitting diode OLED). Thus, the compensation unit 14 can output the compensation data, used for compensating the transistor T152 and the organic light emitting diode OLED, to the source driver 13 according to the voltage $V_{OLED}-(V_0-V_{th})$ including the first and the second parameters. Accordingly, the source driver 13 can adjust the next display data Data so as to compensate the aging of the transistor T152 and the organic light emitting diode OLED in time and prevent the pixel unit 15 from having the incorrect display issue.

In another embodiment, the pixel unit 15 may further include a transistor T153. Please refer to FIG. 4A, which is a schematic circuit diagram of the display unit 15 in accordance with the third embodiment of the present disclosure. The display unit 15 of FIG. 4A in the present embodiment and the display unit 15 of FIG. 2A have similar technology features, no redundant detail is to be given herein. A difference lies in that the display unit 15 of FIG. 4A in the present embodiment further includes a transistor T153. The transistor T153 has a first end, a second end and a control end. The transistor T153 is configured to have its first end for receiving the third low-level voltage $V_L$; its control end for receiving a second control signal S2; and its second end electrically coupled to the second end of the transistor T152 and the first end of the organic light emitting diode OLED. According to the abovementioned circuit configuration, the transistor T153 can maintain both of the second end of the transistor T152 and the first end of the organic light emitting diode OLED to have the third low-level voltage $V_L$ in the initial mode.

Figure 4A:
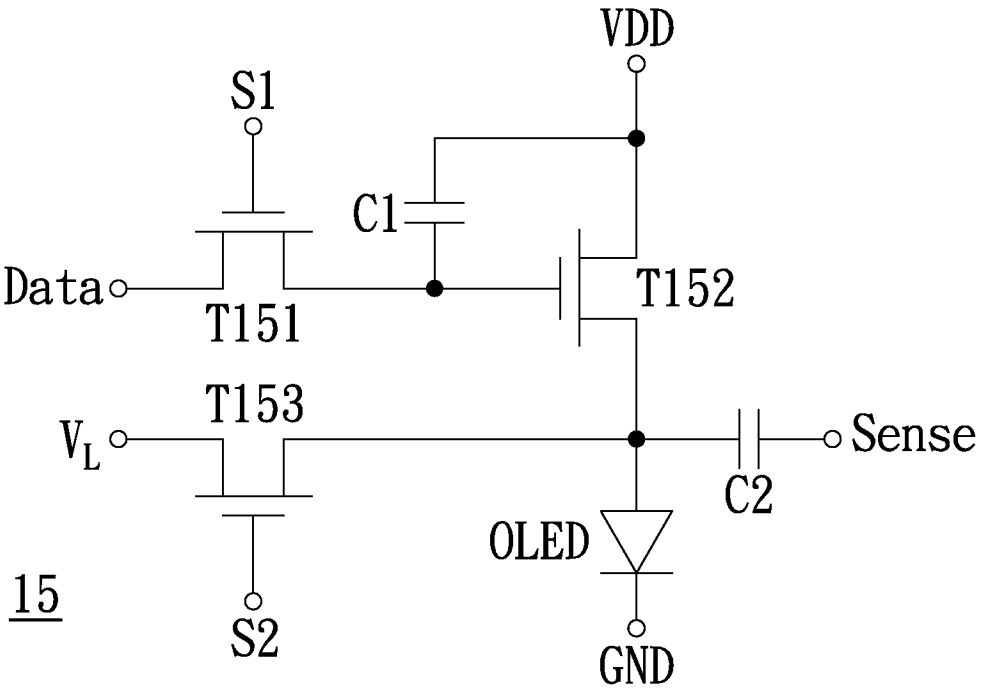
FIG. 4A is a schematic circuit diagram of a display unit in accordance with the third embodiment of the present disclosure.
Figure 4B:
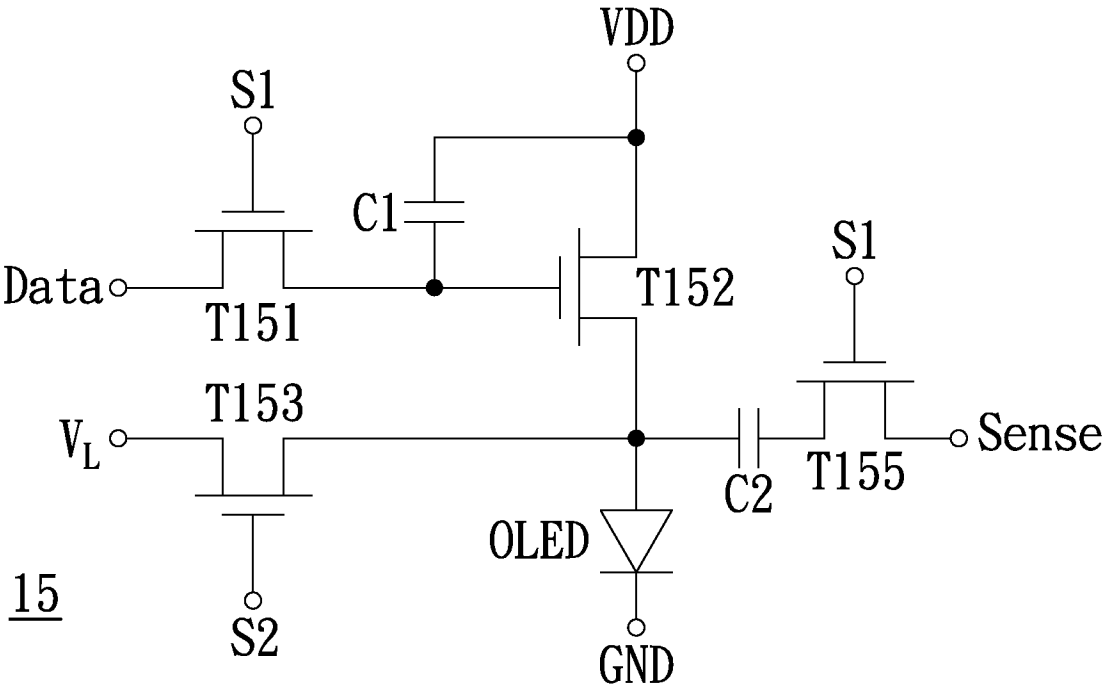
FIG. 4B is a circuit schematic diagram of a display unit in accordance with the fourth embodiment of the present disclosure.

FIG. 4B is a circuit schematic diagram of the display unit 15 in accordance with the fourth embodiment of the present disclosure. The display unit 15 of FIG. 4B in the present embodiment and the display unit 15 of FIG. 4A have similar technology features, no redundant detail is to be given herein. A difference lies in that the display unit 15 of FIG. 4B in the present embodiment further includes a transistor T155. The transistor T155 has a first end, a second end and a control end. The transistor T155 is configured to have its first end electrically coupled to the second end of the capacitor C2; its control end for receiving the first control signal S1; and its second end for determining whether or not to output the sensing voltage Sense to the compensation unit 14 according to the first control signal S1.

Figure 5:
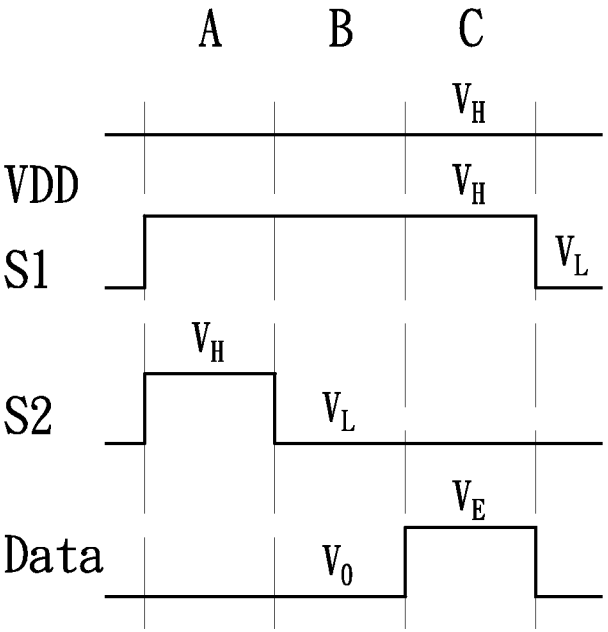
FIG. 5 is a timing chart of the signals related to the pixel units of FIGS. 4A and 4B in accordance with an embodiment of the present disclosure.

FIG. 5 is a timing chart of the signals related to the pixel units 15 of FIGS. 4A and 4B in accordance with an embodiment of the present disclosure. As shown in FIG. 5, the related signals include the power supply voltage VDD, the first control signal S1, the display data Data and the second control signal S2. As shown in FIG. 5, the power supply voltage VDD is always maintained to the high-level voltage $V_H$. Specifically, in the initial mode (i.e. the period A in FIG. 3), the second control signal S2 has the high-level voltage $V_H$. According to the abovementioned signal configuration, because the transistor T153, the second end of the transistor T152 and the first end of the organic light emitting diode OLED are maintained to have the third low-level voltage $V_L$ in the initial mode. In the compensation and display modes, the transistor T153 is OFF due to the second control signal S2 has third low-level voltage $V_L$; thus, the operations of the pixel units 15 of FIGS. 4A and 4B are same as the operations of the pixel units 15 of FIGS. 2A and 2B, and no redundant detail is to be given herein.

Figure 6:
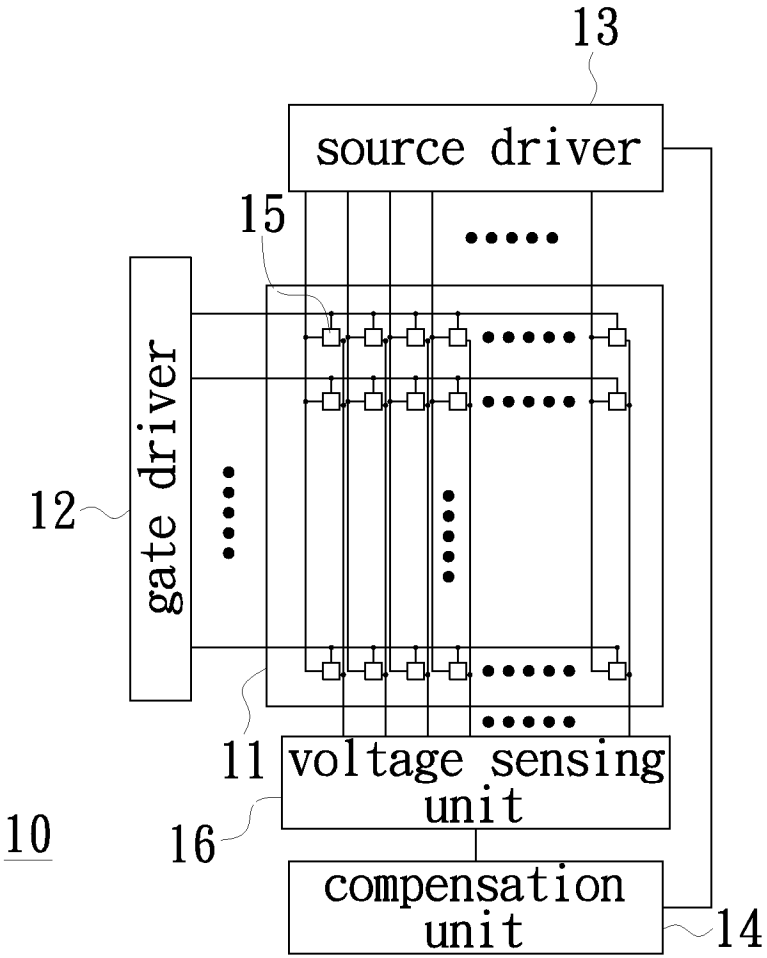
FIG. 6 is a schematic diagram of a display apparatus in accordance with the second embodiment of the present disclosure.

FIG. 6 is a schematic diagram of a display apparatus in accordance with the second embodiment of the present disclosure. As shown in FIG. 1, the display apparatus 10 in the present embodiment includes the display unit 11, the gate driver 12, the source driver 13, the compensation unit 14 and a voltage sensing unit 16. The voltage sensing unit 16, electrically coupled between the pixel unit 15 and the compensation unit 14, is configured to receive the sensing voltage Sense outputted from the pixel unit 15 and accordingly output an output voltage $V_{out}$ to the compensation unit 14. The compensation unit 14 is configured to output compensation data to the source driver 13 according to the received sensing voltage Sense. The source driver 13 is configured to adjust the next display data Data according to the current compensation data, so as to compensate the aging of the components in the pixel unit 15 according to the compensation data and prevent the pixel unit 15 from having the incorrect display issue.

Figure 7:
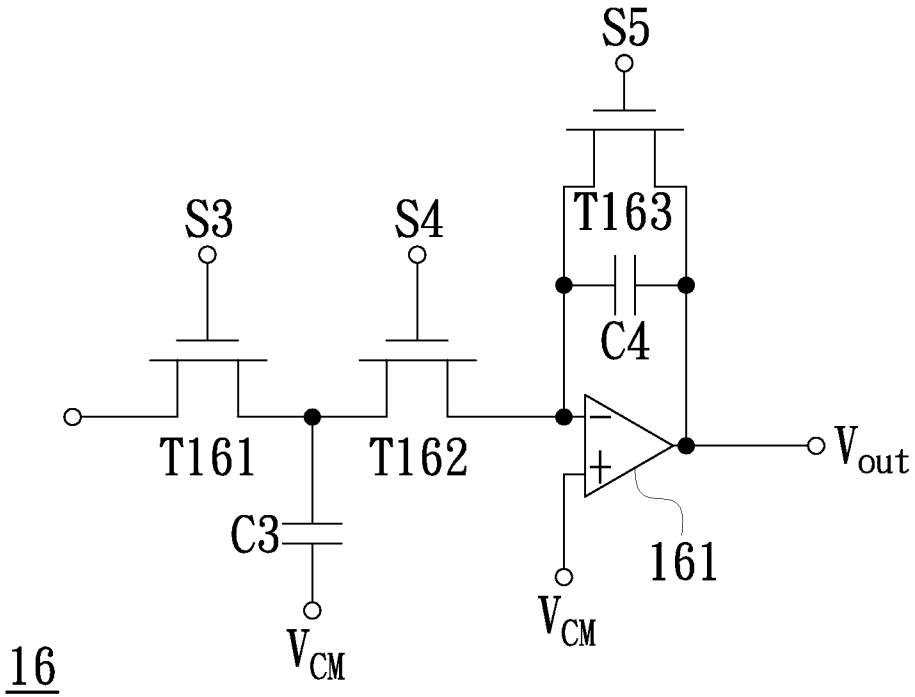
FIG. 7 is a schematic circuit diagram of a voltage sensing unit in accordance with an embodiment of the present disclosure.

FIG. 7 is a schematic circuit diagram of the voltage sensing unit 16 in accordance with an embodiment of the present disclosure. As shown in FIG. 7, the voltage sensing unit 16 in the present embodiment includes a transistor T161, a transistor T162, a transistor T163, a capacitor C3, a capacitor C4 and an operational amplifier 161. The transistor T161 has a first end, a second end and a control end. The transistor T161 is configured to have its first end electrically coupled to the second end of the capacitor C2; and its control end for receiving a third control signal S3. The capacitor C3 has a first end and a second end. The capacitor C3 is configured to have its first end electrically coupled to the second end of the transistor T161; and its second end electrically coupled to a common-mode voltage $V_{CM}$. The transistor T162 has a first end, a second end and a control end. The transistor T162 is configured to have its first end electrically coupled to the first end of the capacitor C3; and its control end for receiving a fourth control signal S4. The operational amplifier 161 has a negative input end, a positive input end and an output end. The operational amplifier 161 is configured to have its negative input end electrically coupled to the second end of the transistor T162; its positive input end electrically coupled to the common-mode voltage $V_{CM}$; and its output end for outputting the output voltage $V_{out}$. The capacitor C4 has a first end and a second end. The capacitor C4 is configured to have its first end electrically coupled to the negative input end of the operational amplifier 161; and its second end electrically coupled to the output end of the operational amplifier 161. The transistor T163 has a first end, a second end and a control end. The transistor T163 is configured to have its first end electrically coupled to the negative input end of the operational amplifier 161; its second end electrically coupled to the output end of the operational amplifier 161; and its control end for receiving a fifth control signal S5.

Figure 8:
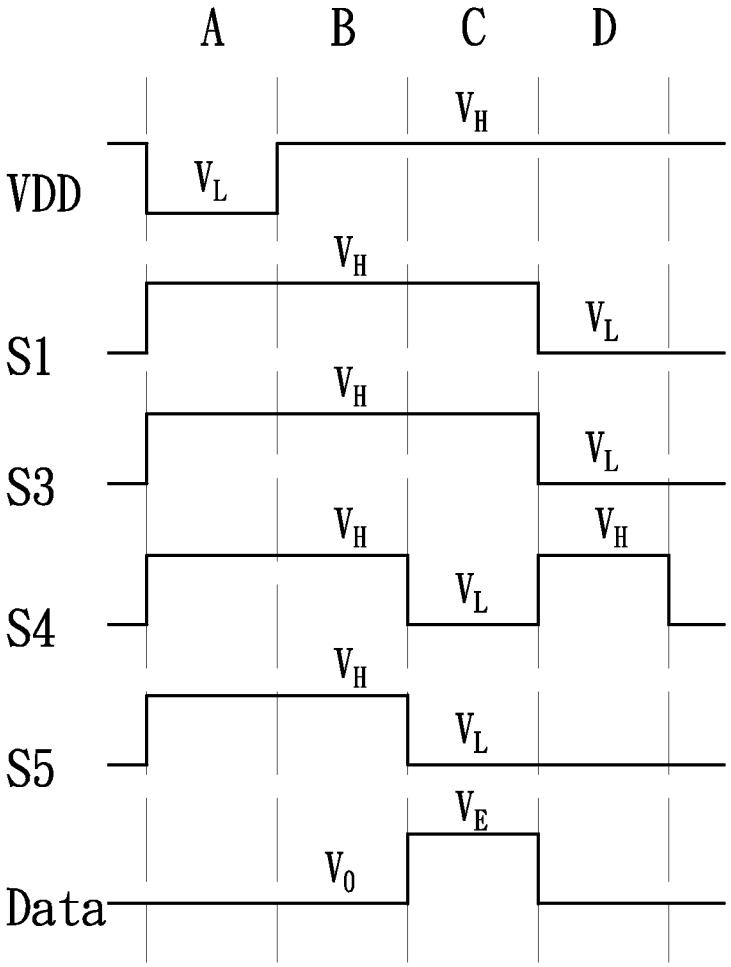
FIG. 8 is a timing chart of the related signals of the display apparatus of FIG. 6 in accordance with an embodiment of the present disclosure.

FIG. 8 is a timing chart of the related signals of the display apparatus 10 of FIG. 6 in accordance with an embodiment of the present disclosure. As shown in FIG. 8, the related signals include the power supply voltage VDD, the first control signal S1, the third control signal S3, the fourth control signal S4, the fifth control signal S5 and the display data Data. The following, in conjunction with FIGS. 2A, 7 and 8, describes an operation method of the display apparatus 10, but the present disclosure is not limited thereto.

First, the pixel unit 15 is operated the initial mode (i.e. the period A in FIG. 8). Specifically, in the initial mode, the display data Data has the second low-level voltage $V_0$; the power supply voltage VDD has the third low-level voltage $V_L$ which is lower than the second low-level voltage $V_0$; and the first control signal S1, the third control signal S3, the fourth control signal S4 and the fifth control signal S5 have the high-level voltage $V_H$. According to the abovementioned signal configuration, the transistor T151 is ON by the first control signal S1; and the second low-level voltage $V_0$ is transmitted to the second end of the transistor T151 and the first end of the capacitor C1 has the second low-level voltage $V_0$. Additionally, because the effect of the power supply voltage VDD, the second end of the capacitor C1 has the third low-level voltage $V_L$; the transistor T152 is ON by the second low-level voltage $V_0$; and the second end of the transistor T152 is maintained to have the third low-level voltage $V_L$ due to the effect of the power supply voltage VDD. Moreover, because the difference between the first low-level voltage GND and the third low-level voltage $V_L$ is smaller than the driving voltage $V_{OLED}$ of the organic light emitting diode OLED, the organic light emitting diode OLED is OFF. Furthermore, because the transistor T161, the transistor T162 and the transistor T163 of the voltage sensing unit 16 are ON by the third control signal S3, the fourth control signal S4 and the fifth control signal S5 having the high-level voltage $V_H$ respectively, the first end of the capacitor C3, the negative input end and the output end of the operational amplifier 161 have the common-mode voltage $V_{CM}$.

Next, the pixel unit 15 is operated in the compensation mode (i.e. the period B in FIG. 8). Specifically, in the compensation mode, the display data Data has the second low-level voltage $V_0$; the power supply voltage VDD has the high-level voltage $V_H$; and the first control signal S1, the third control signal S3, the fourth control signal S4 and the fifth control signal S5 have the high-level voltage $V_H$. According to the abovementioned signal configuration, the transistor T151 is ON by the first control signal S1; and the second low-level voltage $V_0$ is transmitted to the second end of the transistor T151 and the first end of the capacitor C1 has the second low-level voltage $V_0$. Additionally, because the effect of the power supply voltage VDD, the second end of the capacitor C1 has the high-level voltage $V_H$; the transistor T152 is ON by the second low-level voltage $V_0$; the second end of the transistor T152 is converted from having the third low-level voltage $V_L$ to having the high-level voltage $V_H$ and has increasing voltage until the transistor T152 is OFF; and the second end of the transistor T152 is maintained to have a voltage $V_0-V_{th}$. Moreover, because the difference between the first low-level voltage GND and the voltage at the second end of the transistor T152 is smaller than the driving voltage $V_{OLED}$ of the organic light emitting diode OLED, the organic light emitting diode OLED is OFF. Furthermore, because the transistor T161, the transistor T162 and the transistor T163 of the voltage sensing unit 16 are ON by the third control signal S3, the fourth control signal S4 and the fifth control signal S5 having the high-level voltage $V_H$ respectively, the first end of the capacitor C3, the negative input end and the output end of the operational amplifier 161 have the common-mode voltage $V_{CM}$.

Then, the pixel unit 15 is operated in the display mode (i.e. the period C in FIG. 8). Specifically, in the display mode, the display data Data has the display voltage $V_E$; the power supply voltage VDD has the high-level voltage $V_H$; the first control signal S1 and the third control signal S3 have the high-level voltage $V_H$; and the fourth control signal S4 and the fifth control signal S5 have the third low-level voltage $V_L$. According to the abovementioned signal configuration, the transistor T151 is ON by the first control signal S1; the display voltage $V_E$ is transmitted to the second end of the transistor T151 and the first end of the capacitor C1 has the display voltage $V_E$. Additionally, because the effect of the power supply voltage VDD, the second end of the capacitor C1 has the high-level voltage $V_H$; and the transistor T152 is ON by the display voltage $V_E$. Moreover, because the second end of the transistor T152 is maintained to have the driving voltage $V_{OLED}$ due to that both of the power supply voltage VDD and the display voltage $V_E$ are higher than the driving voltage $V_{OLED}$ of the organic light emitting diode OLED, the organic light emitting diode OLED is ON. Because the voltage at the first end of the capacitor C2 increases from $V_0-V_{th}$ in the compensation mode to the driving voltage $V_{OLED}$, correspondingly the second end of the capacitor C2 has a voltage change $V_{OLED}-(V_0-V_{th})$ due to the capacitor coupling feature and consequentially the second end of the capacitor C2 can output the first parameter and the second parameter. Moreover, because the fourth control signal S4 and the fifth control signal S5 have the third low-level voltage $V_L$, the transistor T162 and the transistor T163 are OFF and therefore the capacitor C3 and the capacitor C2 form a loop; wherein the capacitor C3 has a voltage $(V_{OLED}-V_0+V_{th})\times(C2/(C2+C3))$.

Then, the pixel unit 15 is operated in a read mode (i.e. the period D in FIG. 8). Specifically, in the read mode, the power supply voltage VDD has the high-level voltage $V_H$; the first control signal S1, the third control signal S3 and the fifth control signal S5 have the third low-level voltage $V_L$; and the fourth control signal S4 has the high-level voltage $V_H$. According to the abovementioned signal configuration, the transistor T151, the transistor T161 and the transistor T163 are OFF and the transistor T162 is ON by the fourth control signal S4 having the high-level voltage $V_H$ and therefore the capacitor C3 and the capacitor C4 form a loop. Because the voltage difference between the two ends of the capacitor C3 is zero, the charge in the capacitor C3 is transferred to the capacitor C4 therefore the output voltage $V_{out}$ is $(V_{OLED}-V_0+V_{th})\times(C2/(C2+C3))\times(-C3/C4)$, wherein it is understood that the various voltages $-(V_{OLED}-V_0+V_{th})$ can be obtained by adjusting the capacitances of the capacitors C2, C3 and C4. After the read mode, the compensation unit 14 can output compensation data, used to compensate the transistor T152 and the organic light emitting diode OLED, to the source driver 13 according to the output voltage $V_{out}$ including the first parameter and the second parameter. The source driver 13 then adjusts the next display data Data according to the output voltage $V_{out}$. In other words, the source driver 13 can compensate the aging of the transistor T152 and the organic light emitting diode OLED according to the output voltage $V_{out}$ including the first parameter and the second parameter and prevent the pixel unit 15 from having the incorrect display issue.

Figure 9:
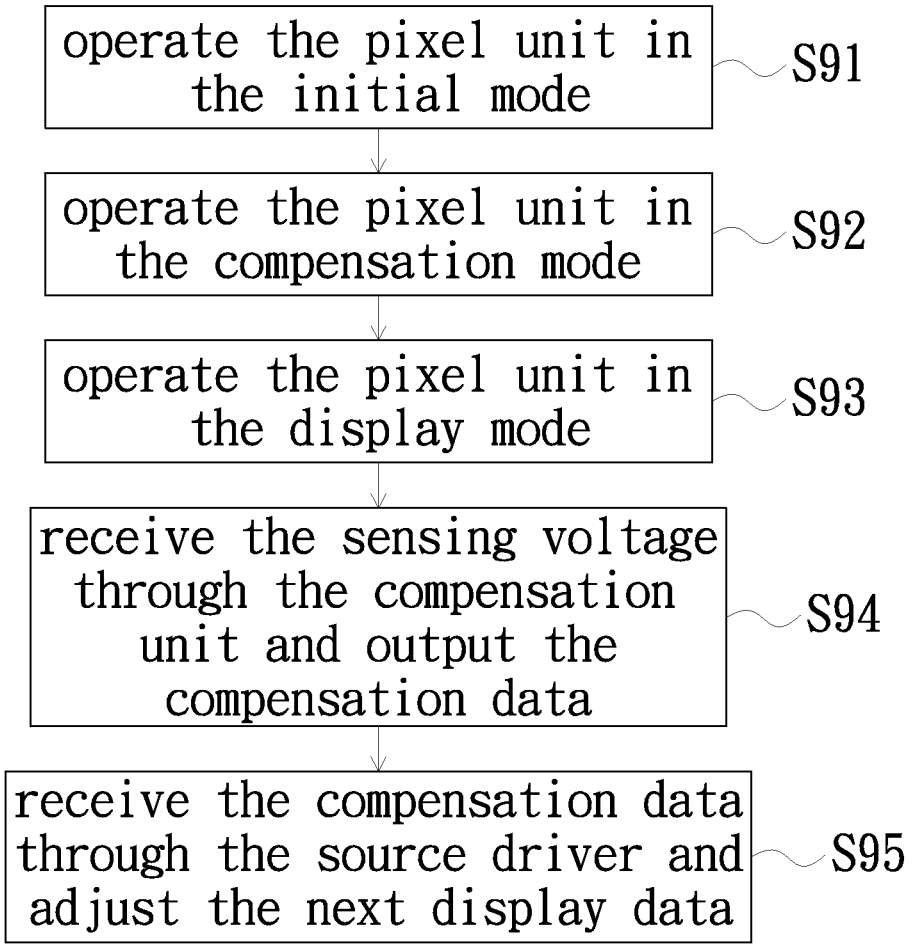
FIG. 9 is a flowchart of an operation method of a display apparatus in accordance with the first embodiment of the present disclosure.

According to the abovementioned embodiments, an operation method of a display apparatus can be developed by those ordinarily skilled in the art. Please refer to FIG. 9, which is a flowchart of an operation method of a display apparatus in accordance with the first embodiment of the present disclosure. The following, in conjunction with the FIG. 9, FIGS. 2 and 3 or FIGS. 4 and 5, describes an operation method of a display apparatus. As shown in FIG. 9, the operation method of a display apparatus in the present embodiment includes steps of: operating the pixel unit 15 in the initial period (step S91) to maintain the voltage at the first end of the organic light emitting diode OLED to the third low-level voltage $V_L$; next, operating the pixel unit 15 in the compensation mode (step S92) to make the first end of the organic light emitting diode OLED have a specified voltage having the first parameter; then, operating the pixel unit 15 in the display mode (step S93), wherein the organic light emitting diode OLED is ON and the capacitor C2 outputs the sensing voltage having a value $V_{OLED}-(V_0-V_{th})$; then, configuring the compensation unit 14 to receive the sensing voltage and output the compensation data (step S94); then, configuring the source driver 13 to receive the compensation data and adjust the next display data by using the compensation data (step S95), so as to compensate the aging of the transistor T152 and the organic light emitting diode OLED.

Figure 10:
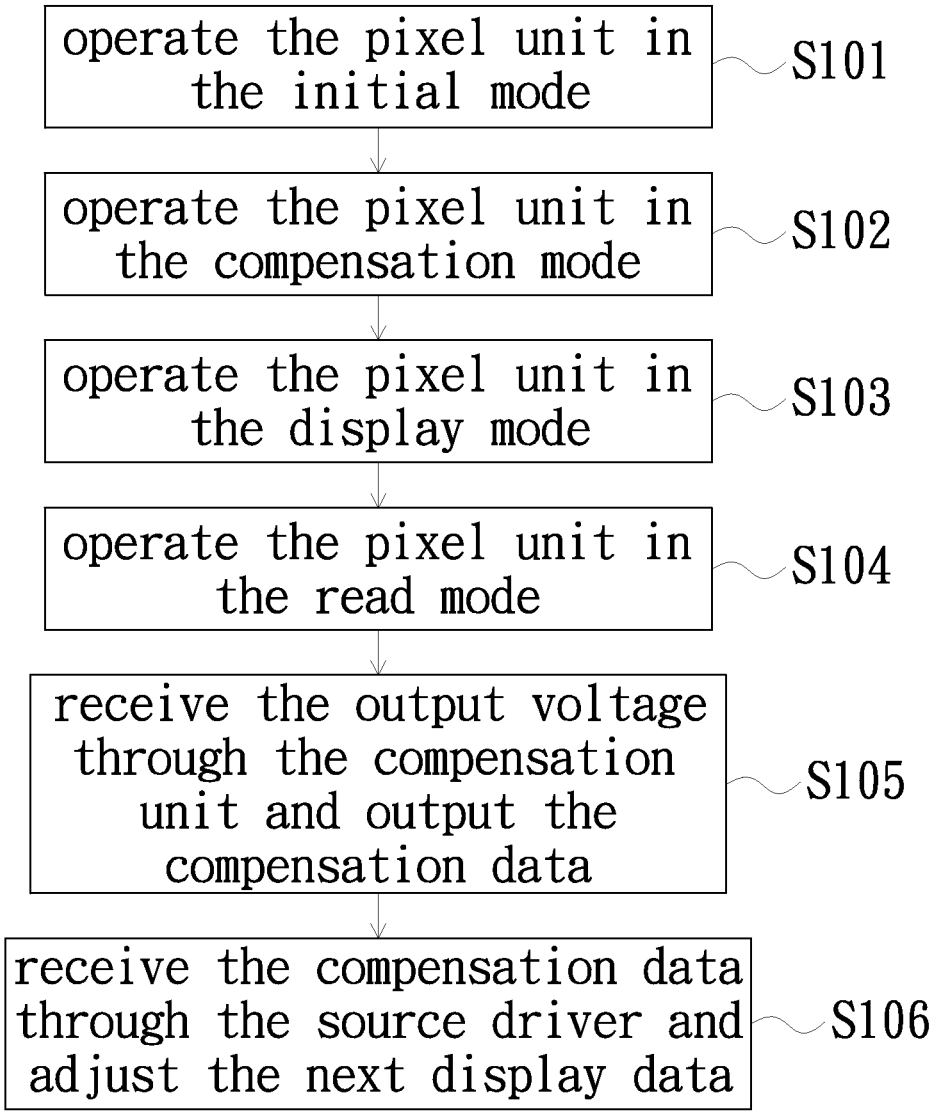
FIG. 10 is a flowchart of an operation method of a display apparatus in accordance with the second embodiment of the present disclosure.

Please refer to FIG. 10, which is a flowchart of an operation method of a display apparatus in accordance with the second embodiment of the present disclosure. The following, in conjunction with the FIG. 3, FIG. 3, FIG. 7 and FIG. 10, describes an operation method of a display apparatus. As shown in FIG. 10, the operation method of a display apparatus in the present embodiment includes steps of: operating the pixel unit 15 in the initial period (step S101) to maintain the voltage at the first end of the organic light emitting diode OLED to the third low-level voltage $V_L$; next, operating the pixel unit 15 in the compensation mode (step S102) to make the first end of the organic light emitting diode OLED have a specified voltage having the first parameter; then, operating the pixel unit 15 in the display mode (step S103), wherein the organic light emitting diode OLED is ON and the capacitor C3 has a voltage $(V_{OLED}-V_0+V_{th})\times(C2/(C2+C3))$ divided from the sensing voltage; then, operating the pixel unit 15 in the read mode (step S104), wherein the capacitor C3 and the capacitor C4 form a loop, the charge in the capacitor C3 is transferred to the capacitor C4 due to the voltage difference between the two ends of the capacitor C3 is zero, therefore the output voltage $V_{out}$ is $(V_{OLED}-V_0+V_{th})\times(C2/(C2+C3))\times(-C3/C4)$; then, configuring the compensation unit 14 to receive the output voltage $V_{out}$ and output the compensation data (step S105); then, configuring the source driver 13 to receive the compensation data and adjust the next display data by using the compensation data (step S106), so as to compensate the aging of the transistor T152 and the organic light emitting diode OLED.

In summary, through output a specified voltage having the first and the second parameters when the pixel unit 15 is operated in the display mode and compensating the transistor T152 and the organic light emitting diode OLED according to the specified voltage having the first and the second parameters, the display apparatus 10 of the present disclosure can compensate the aging of the components by performing one sense operation only. In addition, the pixel unit can perform the sense operation while being operated in the display mode without affecting the display effect, the convenience of the sensing operation increases.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display apparatus, comprising:

a display unit, comprising at least a pixel unit, each pixel unit comprising:

a first transistor, having a first end, a second end and a control end, the first transistor being configured to have its first end for receiving a display data and its control end for receiving a first control signal, wherein the first transistor determines whether or not to output the display data to its second end according to the first control signal;

a second transistor, having a first end, a second end and a control end, the second transistor being configured to have its first end for receiving a power supply voltage and its control end electrically coupled to the second end of the first transistor;

a first capacitor, having a first end and a second end, the first capacitor being configured to have its first end electrically coupled to the second end of the first transistor and its second end electrically coupled to the first end of the second transistor;

a second capacitor, having a first end and a second end, the second capacitor being configured to have its first end electrically coupled to the second end of the second transistor and its second end for outputting a sensing voltage; and an organic light emitting diode, having a first end and a second end, the organic light emitting diode being configured to have its first end electrically coupled to the second end of the second transistor and its second end electrically coupled to a first low-level voltage, wherein when the pixel unit is operated in a display mode, the organic light emitting diode is ON, and the sensing voltage comprises a first parameter having characteristics of the second transistor and a second parameter having characteristics of the organic light emitting diode;

a source driver, electrically coupled to the at least one pixel unit and configured to receive a compensation data and accordingly adjust the next display data; and a compensation unit, disposed between the second capacitor and the source driver and electrically coupled between the second end of the second capacitor and the source driver, wherein the compensation unit receives the sensing voltage and outputs the compensation data according to the received sensing voltage;

wherein when the pixel unit is operated in an initial mode, the display data has a second low-level voltage, the power supply voltage has a third low-level voltage which is lower than the second low-level voltage, the first and the second transistors are ON, and the organic light emitting diode is OFF; wherein when the pixel unit is operated in a compensation mode, the display data has the second low-level voltage, the power supply voltage has a high-level voltage which is higher than the second low-level voltage, the first and the second transistors are ON, and the organic light emitting diode is OFF.

2. The display apparatus according to claim 1, wherein the pixel unit further comprises:

a third transistor, having a first end, a second end and a control end, the third transistor being configured to have its first end for receiving the third low-level voltage, its control end for receiving a second control signal, and its second end electrically coupled to the first end of the organic light emitting diode, wherein the third transistor determines whether or not to pull down a voltage at the first end of the organic light emitting diode to the third low-level voltage according to the second control signal.

3. The display apparatus according to claim 2, wherein when the pixel unit is operated in an initial mode, the display data has the second low-level voltage, the power supply voltage has the high-level voltage, the second low-level voltage is higher than the third low-level voltage, the first, the second and the third transistors are ON, and the organic light emitting diode is OFF.

4. The display apparatus according to claim 1, wherein the pixel unit is further electrically coupled to a voltage sensing unit, the voltage sensing unit is configured to read an output voltage and transmit the output voltage to the compensation unit, the voltage sensing unit comprises:

a third transistor, having a first end, a second end and a control end, the third transistor being configured to have its first end electrically coupled to the second end of the second capacitor and its control end for receiving a third control signal;

a third capacitor, having a first end and a second end, the third capacitor being configured to have its first end electrically coupled to the second end of the third transistor and its second end electrically coupled to a common-mode voltage;

a fourth transistor, having a first end, a second end and a control end, the fourth transistor being configured to have its first end electrically coupled to the first end of the third capacitor and its control end for receiving a fourth control signal;

an operational amplifier, having a negative input end, a positive input end and an output end, the operational amplifier being configured to have its negative input end electrically coupled to the second end of the fourth transistor and its positive input end electrically coupled to the common-mode voltage;

a fifth transistor, having a first end, a second end and a control end, the fifth transistor being configured to have its first end electrically coupled to the negative input end of the operational amplifier, its second end electrically coupled to the output end of the operational amplifier, and its control end for receiving a fifth control signal; and a fourth capacitor, having a first end and a second end, the fourth capacitor being configured to have its first end electrically coupled to the negative input end of the operational amplifier and its second end electrically coupled to the output end of the operational amplifier.

5. The display apparatus according to claim 4, wherein when the pixel unit is operated in the initial mode or the compensation mode, the third, the fourth and the fifth transistors are ON, and the third and the fourth capacitors have the first low-level voltage; wherein when the pixel unit is operated in the display mode, the third transistor is ON, the fourth and the fifth transistors are OFF, the third capacitor stores a dividing sensing voltage divided from the sensing voltage; wherein when the pixel unit is operated in a read mode, the first, the third and the fifth transistors are OFF, the fourth capacitor stores charges of the diving sensing voltage of the third capacitor to obtain the output voltage, wherein the output voltage comprises the first parameter having the characteristics of the second transistor and the second parameter having the characteristics of the organic light emitting diode.

6. An operation method of a display apparatus, the display apparatus comprising a display unit, a source driver and a compensation unit, the display unit comprising at least a pixel unit, each pixel unit comprising a first transistor, a second transistor, a first capacitor, a second capacitor and an organic light emitting diode, the first transistor having a first end, a second end and a control end, the first transistor being configured to have its first end for receiving a display data, its control end for receiving a first control signal, and its second end for outputting the display data, the second transistor having a first end, a second end and a control end, the second transistor being configured to have its first end for receiving a power supply voltage and its control end electrically coupled to the second end of the first transistor, the first capacitor having a first end and a second end, the first capacitor being configured to have its first end electrically coupled to the second end of the first transistor and its second end electrically coupled to the first end of the second transistor, the second capacitor having a first end and a second end, the second capacitor being configured to have its first end electrically coupled to the second end of the second transistor and its second end for outputting a sensing voltage, the organic light emitting diode having a first end and a second end, the organic light emitting diode being configured to have its first end electrically coupled to the second end of the second transistor and its second end electrically coupled to a first low-level voltage, the source driver being electrically coupled to the at least one pixel unit, the compensation unit being disposed between the second capacitor and the source driver and electrically coupled between the second end of the second capacitor and the source driver, the operation method comprising:

operating the pixel unit in a display mode and turning on the organic light emitting diode;

configuring the compensation unit to receive the sensing voltage and output a compensation data; and configuring the source driver to receive the compensation data and adjust the next display data, wherein the sensing voltage comprises a first parameter having characteristics of the second transistor and a second parameter having characteristics of the organic light emitting diode;

wherein when the pixel unit is operated in an initial mode, the display data has a second low-level voltage, the power supply voltage has a third low-level voltage which is lower than the second low-level voltage, the first and the second transistors are ON, and the organic light emitting diode is OFF; wherein when the pixel unit is operated in a compensation mode, the display data has the second low-level voltage, the power supply voltage has a high-level voltage which is higher than the second low-level voltage, the first and the second transistors are ON, and the organic light emitting diode is OFF.

7. The operation method according to claim 6, wherein the pixel unit further comprises: a third transistor, having a first end, a second end and a control end, the third transistor being configured to have its first end for receiving the third low-level voltage, its control end for receiving a second control signal, and its second end electrically coupled to the first end of the organic light emitting diode, wherein the third transistor determines whether or not to pull down a voltage at the first end of the organic light emitting diode to the third low-level voltage according to the second control signal.

8. The operation method according to claim 7, wherein when the pixel unit is operated in the initial mode, the display data has the second low-level voltage, the power supply voltage has the high-level voltage, the second low-level voltage is higher than the third low-level voltage, the first, the second and the third transistors are ON, and the organic light emitting diode is OFF.

9. The operation method according to claim 6, wherein the display apparatus further comprises a voltage sensing unit disposed between the second capacitor and the compensation unit and electrically coupled between the second end of the second capacitor and the compensation unit, the voltage sensing unit comprises a third transistor, a third capacitor, a fourth transistor, an operational amplifier, a fifth transistor and a fourth capacitor, the third transistor has a first end, a second end and a control end, the third transistor is configured to have its first end electrically coupled to the second end of the second capacitor and its control end for receiving a second control signal, the third capacitor has a first end and a second end, the third capacitor is configured to have its first end electrically coupled to the second end of the third transistor and its second end electrically coupled to a common-mode voltage, the fourth transistor has a first end, a second end and a control end, the fourth transistor is configured to have its first end electrically coupled to the first end of the third capacitor and its control end for receiving a third control signal, the operational amplifier has a negative input end, a positive input end and an output end, the operational amplifier is configured to have its negative input end electrically coupled to the second end of the fourth transistor and its positive input end electrically coupled to the common-mode voltage, the fifth transistor has a first end, a second end and a control end, the fifth transistor is configured to have its first end electrically coupled to the negative input end of the operational amplifier, its second end electrically coupled to the output end of the operational amplifier, and its control end for receiving a fourth control signal, and the fourth capacitor has a first end and a second end, the fourth capacitor is configured to have its first end electrically coupled to the negative input end of the operational amplifier and its second end electrically coupled to the output end of the operational amplifier, the operation method further comprises:

operating the pixel unit in a read mode;

configuring the voltage sensing unit to receive a dividing sensing voltage and outputting an output voltage;

configuring the compensation unit to receive the output voltage and output a compensation data; and configuring the source driver to receive the compensation data and adjust the next display data, wherein the output voltage comprises a first parameter having characteristics of the second transistor and a second parameter having characteristics of the organic light emitting diode.

10. The operation method according to claim 9, wherein when the pixel unit is operated in the initial mode or the compensation mode, the third, the fourth and the fifth transistors are ON, and the third and the fourth capacitors have the first low-level voltage; wherein when the pixel unit is operated in the display mode, the third transistor is ON, the fourth and the fifth transistors are OFF, the third capacitor stores the dividing sensing voltage divided from the sensing voltage; wherein when the pixel unit is operated in the read mode, the first, the third and the fifth transistors are OFF, the fourth capacitor stores charges of the diving sensing voltage of the third capacitor to obtain the output voltage, wherein the output voltage comprises the first parameter having the characteristics of the second transistor and the second parameter having the characteristics of the organic light emitting diode.

* * * * *